US005505254A

United States Patent [19]

Chiba

[11] Patent Number: 5,505,254

[45] Date of Patent: Apr. 9, 1996

[54] HEAT EXCHANGER HAVING TUBE SUPPORT PLATE

[75] Inventor: Tomohiro Chiba, Isesaki, Japan

[73] Assignee: Sanden Corporation, Gunma, Japan

[21] Appl. No.: 288,256

[22] Filed: Aug. 11, 1994

[30] Foreign Application Priority Data

Aug. 19, 1993 [JP] Japan ..... 5-225013

[51] Int. Cl.[6] ..... F28F 19/06

[52] U.S. Cl. ..... 165/148; 165/128; 62/285

[58] Field of Search ..... 165/148, 178, 165/913; 62/285

[56] References Cited

U.S. PATENT DOCUMENTS

| | | | |
|---|---|---|---|
| 1,903,125 | 3/1933 | Modine . | |
| 3,018,639 | 1/1962 | Bailey | 62/285 |
| 3,367,132 | 2/1968 | Elliott | 62/285 |
| 3,648,768 | 3/1972 | Scholl . | |
| 3,868,830 | 3/1975 | Fletcher et al. | 62/285 X |
| 3,962,766 | 6/1976 | Pompidor et al. . | |
| 4,235,281 | 11/1980 | Fitch et al. . | |
| 4,279,298 | 7/1981 | Lee | 165/913 X |
| 5,117,650 | 6/1992 | Kim | 62/285 |

FOREIGN PATENT DOCUMENTS 685517 1/1953 .

*Primary Examiner*—John Fox
*Attorney, Agent, or Firm*—Baker & Botts

[57] ABSTRACT

A tube supporting device is provided for supporting closely packed tubes in a heat exchanger. The device has a support plate transversely disposed with respect to the tubes. The support plate has a plurality of holes formed therein which are penetrated by the tubes and which support the tubes against lateral movement. The holes can be a variety of shapes to create one or more gaps between the peripheral surfaces of the holes and the outer surfaces of the tubes. The gaps enhance the flow of condensate which has formed on the tubes and causes the condensate to flow to a bottom portion of the heat exchanger without moving to and collecting on the support plate. The holes also inhibit lateral movement of the tubes.

23 Claims, 3 Drawing Sheets

HEAT EXCHANGER HAVING TUBE SUPPORT PLATE

BACKGROUND OF THE INVENTION

1. Field of the Invention

This invention relates to heat exchangers and, more particularly, to a support plate for supporting tubes in a heat exchanger.

2. Description of the Related Art

Support plates for closely packed tubes in heat exchangers are generally known. Such a support plate is shown, for example, in Japanese Patent Document JP-P-HEI 4-292797 issued to Urabe. Generally, the Urabe heat exchanger is designed for use in an air conditioning system of a motor vehicle. As such, the tubes are typically subjected to vibration from the motor vehicle and from the flow of refrigerant fluid in the cooling circuit. This vibration may cause the tubes to shift, bend, break or otherwise become damaged. Damage to the tubes may, in turn, cause the space between adjacent tubes to be non-uniform and the air flow, which passes across the tubes, to become uneven. This can result in a decrease in the heat exchange efficiency of the heat exchanger. Also, the air resistance of the heat exchanger may increase. Because of these problems, a heat exchanger may be provided with a tube support system to inhibit lateral movement of the tubes.

Referring to FIG. 1 of Urabe, a tube support plate 32 for supporting closely packed heat transfer tubes 15 is typically transversely disposed with respect to heat transfer tubes 15 in the heat exchanger. Tube support plate 32 has a plurality of holes 33, each of which receives a plurality of heat transfer tubes 15. Holes 33 are circular in shape and are respectively identical to, or slightly larger in diameter than, heat transfer tubes 15 to support heat transfer tubes 15 against lateral movement. Referring also to FIG. 2, each hole 34 includes a plurality of projection portions 34*a* extending from an edge thereof. Projection portions 34*a* contact with an outer surface of a heat transfer tube 15 so as to inhibit lateral movement of heat transfer tube 15. A relatively small gap 44 is created between the edges of holes 34 and heat transfer tubes 15.

Generally, the air flow contains moisture in a vapor state. Typically, the vapor is cooled to a temperature below the dew point as the air flow passes across the heat transfer tubes. This temperature reduction changes the vapor into a condensate, which can form on and adhere to the outer surfaces of the heat transfer tubes.

In the Urabe heat exchanger, the condensate which forms on the outer surfaces of heat transfer tubes 15, can move to and collect on tube support plate 32 if the outer surfaces of heat transfer tubes 15 contact the inner edges of holes 33 as shown in FIG. 1. This is undesirable for a variety of reasons including the propagation of rust on plate 32. To solve this problem, the diameter of holes 33 may be enlarged. However, if the diameter of holes 33 is enlarged to avoid contact with tubes 15, support for tubes 15 may become greatly reduced. Alternatively, as shown in FIG. 2, projections 34*a* may be provided to create a gap 44 between the outer surface of heat transfer tube 15 and the edge of hole 34 as shown FIG. 2. However, this alternative solution might present similar problems already considered. For example, if gap 44 is too small, the condensate can encounter difficulty in flowing along the surface of tube 15 and past plate 32. Thus, condensate may move to and collect on plate 32. If projections 34*a* are elongated to enlarge gap 44, the strength of projection 34*a* might become weak and projections 34*a* may be more easily damaged.

Other problems also exist. For example, condensate which collects on tube support plate 32 can be carried to the outside of heat exchanger 10 by the air flow. Thus, engine parts in the vicinity of such a heat exchanger used in a motor vehicle are subject to problems such as corrosion or rust. Moreover, the air resistance of heat exchanger 10 might increase since condensate on plate 32 and tubes 15 disrupts the air flow passing across tubes 15. Because of these and other problems, the heat exchanger cannot maintain the high heat exchange efficiency over extended periods of use.

SUMMARY OF THE INVENTION

It is an object of the invention to provide a heat exchanger which maintain high heat exchange efficiency over extended periods of use by preventing the collection of condensate on a tube support plate of the heat exchanger.

It is another object of the present invention to provide a heat exchanger having heat transfer tubes which are not easily damaged by vibration from a motor vehicle in which the heat exchanger is being used or from the flow of a refrigerant in the heat exchanger.

Accordingly, a tube supporting device is provided for supporting tubes in a heat exchanger. The tubes may have a condensate formed on an outer surface thereof. The tube supporting device has a support plate transversely disposed with respect to the tubes. Holes are formed in the support plate. The tubes penetrate the holes and lateral movement of the tubes is thereby inhibited. The tube supporting device also has means for preventing movement of a portion of the condensation from the tubes to the support plate.

The means for preventing movement of a portion of the condensate to the support plate may include at least one gap formed between each tube and a peripheral surface defining a corresponding hole. This gap may be formed adjacent a downstream side of the tube with respect to a flow of air across the tubes.

The holes may be of a variety of shapes. For instance, substantially rhombus, teardrop, triangle, or square-shaped holes may be used. In conjunction with these or other basic shapes, a portion of the peripheral surface of the hole may be curved so that it contacts a corresponding tube at least one interface defining a curve. This has the technical advantage of supporting the tubes with linear or arcuate contact as opposed to point contact support. Alternatively, the basic shape of a hole may provide contact at three or more points to support the corresponding tube. This arrangement has the technical advantage of providing 5point contact without the need for projection portions extending from the peripheral surface of the hole.

Another technical advantage of the present invention is that the condensate may move along the outer surface of the tubes and through the gap without moving to the support plate. This may be achieved, in part, by forming relatively large gaps as compared to gaps used in the prior art. This advantage may also be achieved, in part, due to the positioning of the gaps at the downstream sides of the tubes with respect to the flow of air across the tubes. The air flow can thereby force the condensate to the downstream sides of the tubes where gravity can cause the condensate to flow down the tubes and through the gaps.

When used in a typical heat exchanger, these features facilitate flow of the condensate to a bottom portion of the heat exchanger. Thus, condensate is not carried away from the heat exchanger by the air flow. This can minimize rusting of parts in the vicinity of the heat exchanger (e.g., motor vehicle engine parts). Further, the support plate can more firmly support the heat transfer tubes, thereby preventing damage to the tubes. Also, air resistance of the heat exchanger is minimized since the air flow smoothly passes across the heat transfer tubes without the resistance of the condensate. This maximizes the efficiency of the heat exchanger.

Further objects, features and advantages of the present invention will be understood from the following detailed description of the preferred embodiments with reference to the appropriate figures.

DETAILED DESCRIPTION OF THE PREFERRED EMBODIMENTS

Figure 3:
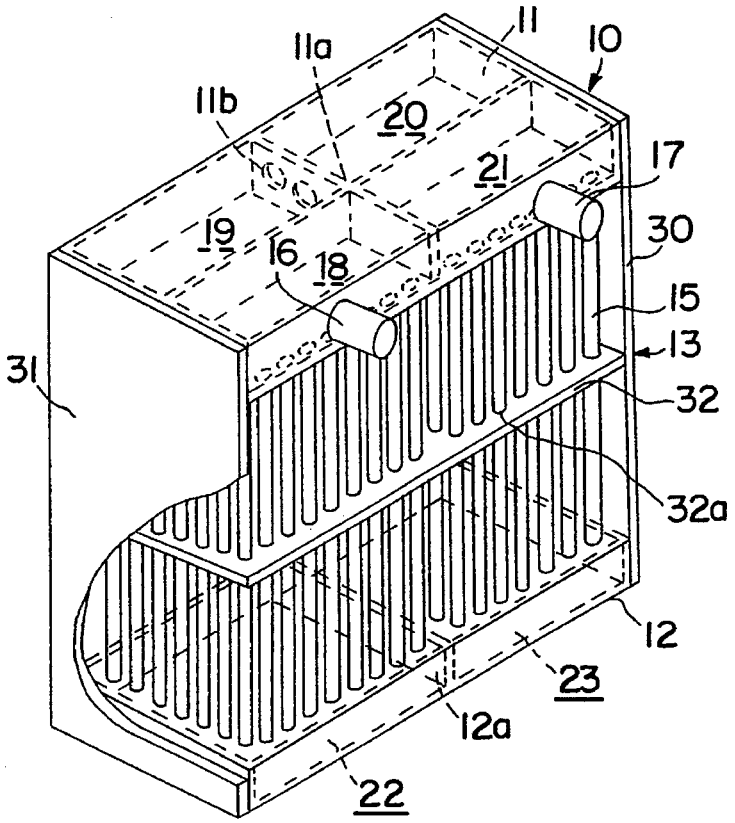
FIG. 3 is a perspective view of a heat exchanger in accordance with an embodiment of the present invention.
Figure 4:
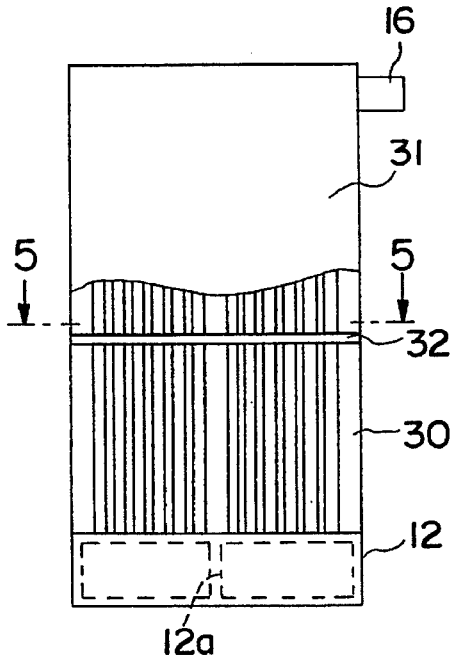
FIG. 4 is a side view of the heat exchanger depicted in FIG. 3.

Referring to FIGS. 3 and 4, heat exchanger 10 comprises an upper tank 11 and a lower tank 12. A heat exchanger core 13 is disposed between upper tank 11 and lower tank 12. Heat exchanger core 13 comprises a plurality of heat transfer tubes 15 spaced apart and substantially parallel to one another. As shown in FIG. 3, upper tank 11 may be divided by an upper partition 11*a* into four chambers including first upper chamber 18, second upper chamber 19, third upper chamber 20 and fourth upper chamber 21. Chambers 18, 19, 20 and 21 all preferably have the same capacity. Lower tank 12 may be divided by a lower partition 12*a* into two chambers including first lower chamber 22 and second lower chamber 23.

Upper partition 11*a* preferably has a plurality of holes 11*b* formed therein to link second upper chamber 19 and third upper chamber 20 so as to permit fluid communication between chamber 19 and chamber 20. First upper chamber 18 and fourth upper chamber 21 are respectively provided with inlet pipe 16 and outlet pipe 17. Inlet pipe 16 and outlet pipe 17 preferably connect heat exchanger 10 to the remainder of a vehicle air conditioning system (not shown).

Heat exchanger core 13 comprises a plurality of heat transfer tubes, each of which is connected at a first end to upper tank 11 and at a second end to lower tank 12. A first side plate 30 is connected at a first end to upper tank 11 and at a second end to lower tank 12. Similarly, a second side plate 31 is connected at a first end to upper tank 11 and at a second end to lower tank 12. Support plate 32 is disposed within core 13 between upper tank 11 and lower tank 12 and is preferably connected at a first end to first side plate 30 and at a second end to second side plate 31. Support plate 32 is preferably substantially parallel to both upper and lower tanks 11 and 12. Support plate 32 has a plurality of holes 32*a*. Heat transfer tubes 15 penetrate holes 32*a* and are thereby supported so that lateral movement of tubes 15 is inhibited.

In operation, a heat exchanger medium (not shown) is introduced through inlet pipe 16 into first upper chamber 18. The medium flows down through one or more tubes 15 and reaches first lower chamber 22 of lower tank 12. From this location, the medium flows back up through tubes 15 to second upper chamber 19. Then, the medium flows to upper chamber 20 through holes 11*b* of upper partition 11*a*, down one or more of tubes 15 and into second lower chamber 23. Continuing, the medium flows back up tubes 15 into fourth upper chamber 21. Finally, the medium exits chamber 21 through outlet pipe 17.

Holes 32*a* are each defined by a peripheral surface which contacts a corresponding heat transfer tube 15 at one or more interfaces which define points, lines or curves. Holes 32*a* are formed to have shapes according to various embodiments of the present invention depicted in FIGS. 5–8.

Figure 5:
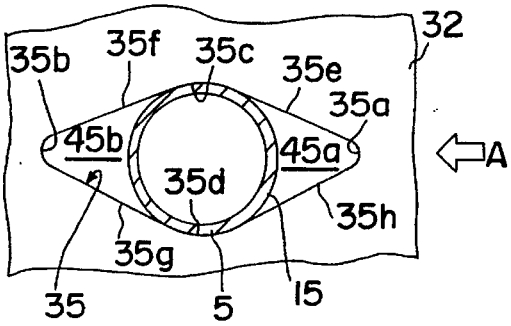
FIG. 5 is a partial cross-sectional view of a heat exchanger taken along line 5—5 of FIG. 4 in accordance with an embodiment of the present invention.

According to an embodiment shown in FIG. 5, hole 35 of tube support plate 32 is formed to be generally rhombus-shaped. The vertices of rhombus holes 35 are preferably modified to be arc-shaped as depicted in FIG. 5. A first pair of arc-shaped vertices 35*a* and 35*b* are formed opposite each other and are defined by the respective pairs of sides which form acute angles. The radii of arc-shaped vertices 35*a* and 35*b* are unequal to, and preferably smaller than, the radius of the corresponding heat transfer tube 15. A second pair of arc-shaped vertices 35*c* and 35*d* are formed opposite each other and are defined by the respective pairs of sides which form obtuse angles. The radii of arc-shaped portion 35*c* and 35*d* are generally equal to, or slightly larger than, the radius of the corresponding heat transfer tube 15. Linear portions 35*e*, 35*f*, 35*g* and 35*h* join arc-shaped portions 35*a*, 35*b*, 35*c* and 35*d*.

Therefore, the peripheral surface of hole defines a simple closed curve. In other words, the curve begins and ends at the same point and does not cross itself. Moreover, the curve defined by hole 35 represents a convex figure. A convex figure is one in which, as the curve is traced from one point to subsequent adjacent points, the slope either does not change or changes in only one direction. Therefore, the curve does not turn back in on itself.

Heat transfer tube 15 penetrates, and is laterally supported by, rhombus hole 35. This support is provided, at least partially, by arcuate contact between the peripheral surface of rhombus hole 35 and heat transfer tube 15. This arcuate contact is generally made at the second pair of arc-shaped portions 35*c* and 35*d*. First and second gaps 45*a* and 45*b*, which are generally triangle-shaped, are formed adjacent tube 15 on the upstream and downstream sides of tube 15 with respect to an air flow indicated by arrow A. Gap 45*a* is partially defined by arc-shaped portion 35*a* and gap 45*b* is partially defined by arc-shaped portion 35*b*. Although gaps 45*a* and 45*b* are preferably positioned as depicted in FIG. 5, with respect to air flow A, this positioning may be modified.

During operation, air flow A may contain moisture in a vapor state. Typically, the vapor is cooled to a temperature below the dew point as the air flow passes across heat transfer tubes 15. This temperature reduction can change the vapor into a condensate, which can form on and adhere to the outer surfaces of heat transfer tubes 15. As discussed above in connection with FIGS. 3 and 4, holes 32*a* are formed to have shapes according to various embodiments of the present invention depicted in FIGS. 5–8. These shapes are different than the cross-sectional shape of tube 15 in the axial direction (i.e., circular in FIGS. 5–8). This difference in shape causes gaps to be formed between the peripheral surface of a hole and the outer surface of a corresponding heat transfer tube. The flow of condensate through the holes to a bottom portion of the heat exchanger is at enhanced at least partially due to these gaps. A portion of the condensate is thereby prevented from moving to and collecting on the support plate.

In connection with the embodiment shown in FIG. 5, for example, rhombus holes 35 facilitate the flow of condensate through gaps 45*a* and 45*b*, thereby avoiding the movement of a portion of the condensate from heat transfer tubes 15 to support plate 32. The majority of the condensate flows through gap 45*b* to the bottom of heat exchanger 10 because air flow A tends to force the condensate downstream laterally around the outer surface of heat transfer tube 15. Further, as described above, support plate 32 firmly supports heat transfer tubes 15 with linear or arcuate contact as opposed to the point contact support provide by conventional support plates (e.g., FIG. 2).

Figure 1:
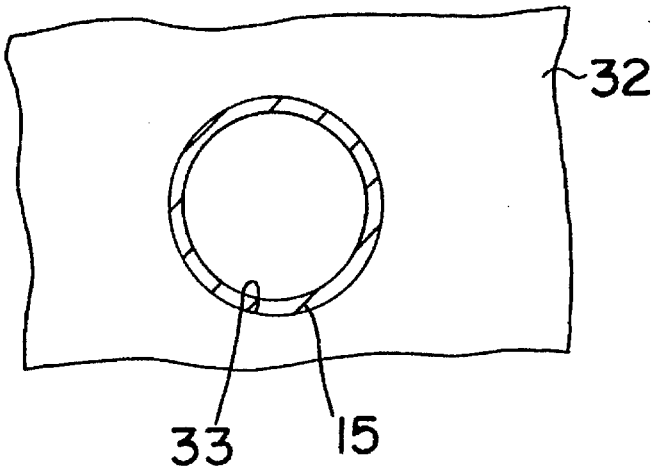
FIG. 1 PRIOR ART
FIG. 1 is a partial cross-sectional view in accordance with the prior art.
Figure 2:
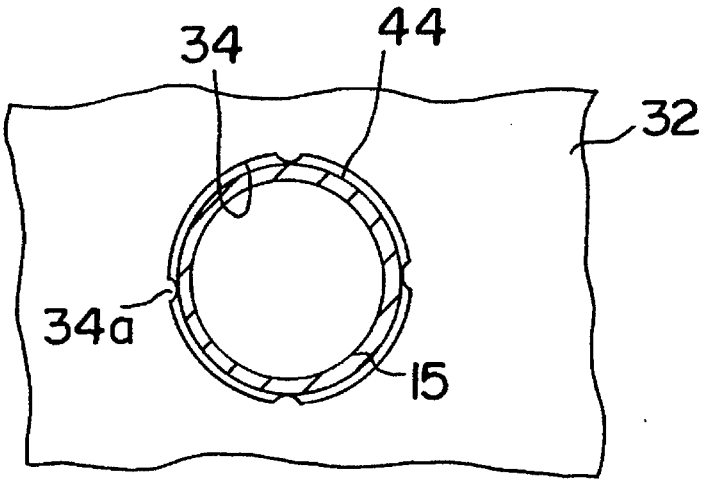
FIG. 2 PRIOR ART
FIG. 2 is a partial cross-sectional view in accordance with the prior art.

The flow of condensate along the outer surface of tubes 15 without moving to support plate 32 is improved over that of conventional structures in part because the cross-sectional area of gaps 45*a* and 45*b* can be made larger than that of conventional gaps (e.g., gap 44 of FIG. 2). At the same time, the tube support provided by the structure described above in connection with FIG. 5 will be at least as great as that provided by conventional tube support structures. Further, the strength of the support structure itself is improved over conventional structures such as that shown in FIG. 2. This is at least partially due to the use of linear or arcuate contact between the support plate and the heat transfer tubes.

Also, the enhanced flow provided by the structure shown in FIG. 5 reduces the scattering of condensate to areas outside of heat exchanger 10. As a result, components in the vicinity of heat exchanger 10 (e.g., engine parts of a motor vehicle) are not subjected to adverse effects, such as corrosion or rust, which can be caused by the condensate. Further, the air resistance of heat exchanger 10 is minimized because air smoothly passes across adjacent heat transfer tubes 15 without the resistance of the condensate. Moreover, the improved support reduces damage to heat transfer tubes 15, thereby promoting more uniform air flow. This further minimizes air resistance of heat exchanger 10. Thus, heat exchanger 10 can maintain a high heat exchange efficiency.

Figure 6:
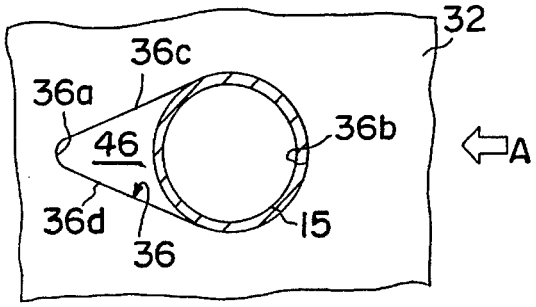
FIG. 6 is a partial cross-sectional view of the heat exchanger of FIG. 4 in accordance with another embodiment of the present invention.

FIG. 6 illustrates another embodiment of the present invention in which each hole 36 of support plate 32 is generally teardrop-shaped. Tear drop hole 36 is similar to rhombus hole 35 of FIG. 5 except that teardrop hole 36 has only one vertex 36*a* which is modified to be arc-shaped as shown in FIG. 6. The radius of arc-shaped vertex 36*a* is unequal to, and preferably smaller than, the radius of the corresponding heat transfer tube 15. Further, hole 36 includes a partially circular portion 36*b* which has a radius generally equal to, or slightly larger than, the radius of the corresponding heat transfer tube 15. Teardrop hole 36 has two linear portions 36*c* and 36*d*, which joins arc-shaped vertex 36*a* partially-circular portion 36*b*.

Heat transfer tube 15 penetrates, and is laterally supported by, teardrop hole 36. Support is provided, at least in part, by arcuate contact between the peripheral surface of teardrop hole 36 and heat transfer tube 15. This arcuate contact is generally made at partially circular portion 36*b*. Gap 46, which is generally triangle-shaped, is formed adjacent tube 15 on the downstream side of tube 15 with respect to air flow A. Gap 46 is partially defined by arc-shaped vertex 36*a*. The positioning of gap 46 with respect to air flow A may be modified.

Teardrop holes 36 facilitate the flow of condensate through gap 46, thereby avoiding the movement of a portion of the condensate from heat transfer tubes 15 to support plate 32. The condensate flows through gap 46 to the bottom of heat exchanger 10 because air flow A tends to force the condensate downstream laterally around the outer surface of heat transfer tube 15. Further, as described above, support plate 32 firmly supports heat transfer tubes 15 with linear or arcuate contact as opposed to the point contact support provide by conventional support plates (e.g., FIG. 2). The advantages of this embodiment are similar to those described above in connection with the structure depicted in FIG. 5.

Figure 7:
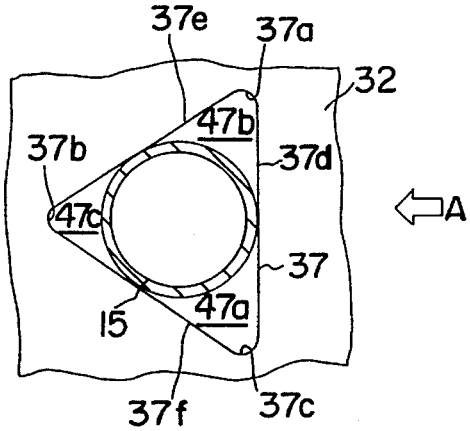
FIG. 7 is a partial cross-sectional view of the heat exchanger of FIG. 4 in accordance with yet another embodiment of the present invention.

FIG. 7 illustrates yet another embodiment of the present invention in which holes 37 of support plate 32 are generally triangle-shaped. Triangle holes 37 have three vertices 37*a*, 37*b* and 37*c* which are modified to be arc-shaped. Arc-shaped vertices have radii which are unequal to, and preferably smaller than, the radius of the corresponding heat transfer tube 15. Hole 37 also has three linear portions 37*d*, 37*e* and 37*f*, which are preferably equal in length and which join arc-shaped vertices 37*a*, 37*b* and 37*c*.

Preferably, the diameter of a circle inscribed in triangle hole 37 and which contacts linear portions 37*d*, 37*e* and 37*f*, is identical to or slightly larger than that of the corresponding heat transfer tube 15. Thereby, heat transfer tube 15 contacts the peripheral surface of triangle hole 37 essentially at the midpoints of the three linear portions 37*d*, 37*e* and 37*f* of hole 37. As with the other embodiments, tube 15 is preferably firmly supported by hole 37 in a lateral direction.

Gaps 47*a*, 47*b* and 47*c* are formed adjacent tube 15 and are partially defined by arc-shaped vertices 37*a*, 37*b* and 37*c*. Preferably, at least one gap (e.g., gap 47*c* in FIG. 7) is formed on side of tube 15 which is downstream with respect to air flow A. However, the positioning of gaps 47*a*, 47*b* and 47*c* may be different from that shown in FIG. 7. In operation of heat exchanger 10, these gaps function similar to the gaps described in the previous embodiments and the details, therefore, are omitted.

Although similar advantages are achieved, the structure of this embodiment provides point contact support against the lateral movement of heat transfer tubes 15. However, this embodiment is different than conventional structures in that it avoids the use of projection portions which extend inward from the peripheral surface of the hole. Thus, firm point contact-type support is provided together with relatively large gaps without the danger of weakening the projection portions of conventional structures by elongating them to increase the size of the gaps.

Figure 8:
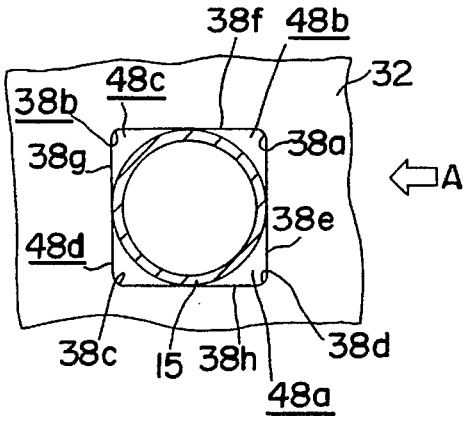
FIG. 8 is a partial cross-sectional view of the heat exchanger of FIG. 4 in accordance with yet another embodiment of the present invention.

FIG. 8 illustrates another embodiment of the present invention in which each hole 38 is formed to generally square-shaped. Square hole 38 includes four vertices 38*a*, 38*b*, 38*c* and 37*d* which are modified to be arc-shaped and which have radii that are unequal to, and preferably smaller than, the radius of the corresponding heat transfer tube 15. Further, square hole 38 has four linear portions 38*e*, 38*f*, 38*g* and 38*h*, which are preferably equal in length and which join arc-shaped vertices 38*a*, 38*b*, 38*c* and 38*d*. The diameter of a circle inscribed in square hole 38 is identical or slightly larger than that of heat transfer tube 15. Heat transfer tubes 15 thus contacts with four points on the peripheral surface of square holes 38 so as to be firmly supported against lateral movement.

Gaps 48*a*, 48*b*, 48*c* and 48*d* are formed adjacent tube 15 and are partially defined by arc-shaped vertices 38*a*, 38*b*, 38*c* and 38*d*. Preferably, at least one gap is located downstream with respect to air flow A. However, the positioning of the gaps may be modified. The gaps of this embodiment function in a manner similar to that of the previously-described embodiment and similar advantages over conventional tube supporting structures are achieved.

This invention has been described in connection with the preferred embodiment. These embodiments, however, are merely exemplary and the invention is not restricted thereto. It will be easily understood by those having ordinary skill i the relevant art that variations can be easily made within the scope of this invention as defined by the claims which follow.

I claim:

1. A tube supporting device for supporting at least one tube disposed in a heat exchanger, wherein the at least one tube has a condensate formed on an outer surface thereof, said tube supporting device comprising:

at least one support plate disposed in the heat exchanger transversely with respect to the at least one tube, said support plate having at least one hole formed therein, the at least one hole defined by a peripheral surface, the at least one tube penetrating the at least one hole so that lateral movement of the at least one tube is inhibited; and preventing means for preventing a portion of the condensate on the at least one tube from moving to said support plate, said preventing means comprising the peripheral surface of the at least one hole being formed to define a closed curve having a linear portion, said preventing means creating at least one gap between the at least one tube and the peripheral surface of the at least one hole.

2. The tube supporting device of claim 1 wherein the at least one tube is exposed to an air flow, the at least one gap being formed on a side of the at least one tube, said side being downstream with respect to the air flow.

3. The tube supporting device of claim 1, said peripheral surface of the at least one hole contacting the at least one tube at an interface, the interface defining a curve.

4. The tube supporting device of claim 3, the at least one hole being substantially rhombus-shaped.

5. The tube supporting device of claim 3, the at least one hole being substantially teardrop-shaped.

6. The tube supporting device of claim 1, said peripheral surface of the at least one hole contacting three or more discrete points on the outer surface of the at least one tube.

7. The tube supporting device of claim 6, the at least one hole being substantially triangle-shaped.

8. The tube supporting device of claim 6, the at least one hole being substantially square-shaped.

9. A heat exchanger comprising:

a first tank;

a second tank;

at least one heat transfer tube having a first end connected to said first tank and a second end connected to said second tank, wherein said at least one heat transfer tube has a condensate formed on an outer surface thereof;

a first plate member having a first end connected to said first tank and a second end connected to said second tank;

a second plate member having a first end connected to said first tank and a second end connected to said second tank, said at least one heat transfer tube disposed between said first plate member and said second plate member;

at least one support plate disposed between said first tank and said second tank, said support plate having a first end connected to said first plate member and a second end connected to said second plate member, said support plate member having at least one hole formed therein, the at least one hole defined by a peripheral surface, said at least one tube penetrating the at least one hole so that lateral movement of said at least one tube is inhibited; and preventing means for preventing a portion of the condensate on said at least one heat transfer tube from moving to said support plate, said preventing means comprising the peripheral surface of the at least one hole being formed to define a closed curve having a linear portion, said preventing means creating at least one gap between the at least one tube and the peripheral surface of the at least one hole.

10. The heat exchanger of claim 9 wherein said at least one tube is exposed to an air flow, the at least one gap being formed on a side of said at least one tube, said side being downstream with respect to the air flow.

11. The heat exchanger of claim 9, said peripheral surface of the at least one hole contacting the at least one tube at an interface, the interface defining a curve.

12. The heat exchanger of claim 11, the at least one hole being substantially rhombus-shaped.

13. The heat exchanger of claim 11, the at least one hole being substantially teardrop-shaped.

14. The heat exchanger of claim 9, said peripheral surface of the at least one hole contacting three or more discrete points on the outer surface of the at least one tube.

15. The heat exchanger of claim 14, the at least one hole being substantially triangle-shaped.

16. The heat exchanger of claim 14, the at least one hole being substantially square-shaped.

17. A tube supporting device for supporting at least one tube disposed in a heat exchanger, wherein the at least one tube has a condensate formed on an outer surface thereof, said tube supporting device comprising:

at least one support plate disposed in the heat exchanger transversely with respect to the at least one tube, said support plate having at least one hole formed therein, the at least one hole being deformed by a peripheral surface, the at least one tube penetrating the at least one hole and contacting said peripheral surface to inhibit lateral movement of the at least one tube, said peripheral surface defining a closed curve having a linear portion to create at least one gap between said peripheral surface and the at least one tube, the at least one gap enhancing flow of the condensate through the at least one gap to prevent a portion of the condensate from moving to said support plate.

18. The tube supporting device of claim 17, wherein the at least one tube is exposed to an air flow, the at least one gap being formed on a side of the at least one tube, said side being downstream with respect to the air flow.

19. The tube supporting device of claim 17, the at least one tube contacting said peripheral surface by arcuate contact.

20. The tube supporting device of claim 17, the at least one tube contacting said peripheral surface by point contact.

21. A tube supporting device for supporting at least one tube disposed in a heat exchanger, wherein the at least one tube has a condensate formed on an outer surface thereof, said tube supporting device comprising:

at least one support plate disposed in the heat exchanger transversely with respect to the at least one tube, said support plate having at least one hole formed therein, the at least one hole defined by a peripheral surface, the at least one tube penetrating the at least one hole so that lateral movement of the at least one tube is inhibited; and preventing means formed in the at least one hole for preventing a portion of the condensate on the at least one tube from moving to said support plate, said preventing means comprising the peripheral surface of the at least one hole being formed to define a simple closed curve and convex figure, said preventing means creating at least one gap between the at least one tube and the peripheral surface of the at least one hole.

22. A heat exchanger comprising:

a first tank;

a second tank;

at least one heat transfer tube having a first end connected to said first tank and a second end connected to said second tank, wherein said at least one heat transfer tube has a condensate formed on an outer surface thereof;

a first plate member having a first end connected to said first tank and a second end connected to said second tank;

a second plate member having a first end connected to said first tank and a second end connected to said second tank, said at least one heat transfer tube disposed between said first plate member and said second plate member;

at least one support plate disposed between said first tank and said second tank, said support plate having a first end connected to said first plate member and a second end connected to said second plate member, said support plate member having at least one hole formed therein, the at least one hole defined by a peripheral surface, said at least one tube penetrating the at least one hole so that lateral movement of said at least one tube is inhibited; and preventing means formed in the at least one hole for preventing a portion of the condensate on said at least one heat transfer tube from moving to said support plate, said preventing means comprising the peripheral surface of the at least one hole being formed to define a simple closed curve band convex figure, said preventing means creating at least one gap between the at least one tube and the peripheral surface of the at least one hole.

23. A tube supporting device for supporting at least one tube disposed in a heat exchanger, wherein the at least one tube has a condensate formed on an outer surface thereof, said tube supporting device comprising:

at least one support plate disposed in the heat exchanger transversely with respect to the at least one tube, said support plate having at least one hole formed therein, the at least one hole being defined by a peripheral surface, the at least one tube penetrating the at least one hole and contacting said peripheral surface to inhibit lateral movement of the at least one tube, said peripheral surface defining a simple closed curve and convex figure to create at least one gap between said peripheral surface and the at least one tube, the at least one gap enhancing flow of the condensate through the at least one gap to prevent a portion of the condensate from moving to said support plate.

* * * * *